US008668491B2

(12) United States Patent
Praat et al.

(10) Patent No.: US 8,668,491 B2
(45) Date of Patent: Mar. 11, 2014

(54) REGULATING DEVICE FOR GAS BURNERS

(75) Inventors: Jos Praat, Borger (NL); Enno Vrolijk, Dalen (NL)

(73) Assignee: Honeywell Technologies SARL, Rolle (CH)

( * ) Notice: Subject to any disclaimer, the term of this patent is extended or adjusted under 35 U.S.C. 154(b) by 492 days.

(21) Appl. No.: 12/898,478

(22) Filed: Oct. 5, 2010

(65) Prior Publication Data

US 2011/0081619 A1 Apr. 7, 2011

(30) Foreign Application Priority Data

Oct. 6, 2009 (DE) ..... 10 2009 048 405

(51) Int. Cl.
*F23N 5/24* (2006.01)

(52) U.S. Cl.
USPC ..... 431/89; 236/15 BD; 431/12; 431/354

(58) Field of Classification Search
USPC ..... 431/89, 354, 12; 340/605; 236/15 BD
See application file for complete search history.

(56) References Cited

U.S. PATENT DOCUMENTS

| | | | | |
|---|---|---|---|---|
| 2,021,241 | A | 11/1935 | Mall | |
| 2,743,771 | A * | 5/1956 | Eadon-Clarke | 431/86 |
| 2,771,308 | A | 11/1956 | Vitcha et al. | |
| 3,072,390 | A | 1/1963 | Phillips | |
| 3,299,940 | A * | 1/1967 | Phillips et al. | 137/606 |
| 3,455,260 | A | 7/1969 | Mennesson | |
| 3,538,940 | A | 11/1970 | Graham | |
| 3,574,359 | A | 4/1971 | Klein | |
| 3,593,967 | A | 7/1971 | Nutten | |
| 4,009,986 | A * | 3/1977 | Eckert | 431/90 |
| 4,033,714 | A | 7/1977 | Longworth | |
| 4,116,476 | A | 9/1978 | Porter et al. | |
| 4,128,391 | A | 12/1978 | Braunstein | |

(Continued)

FOREIGN PATENT DOCUMENTS

| | | |
|---|---|---|
| DE | 1972904 | 11/1967 |
| DE | 1601192 | 12/1970 |

(Continued)

OTHER PUBLICATIONS

Honeywell, VK41..R/VK81..R Series, Gas Controls With Integrated Gas/Air Module for Combined Valve and Ignition System, pp. 1-6, prior to Oct. 18, 2006.

(Continued)

*Primary Examiner* — Kenneth Rinehart
*Assistant Examiner* — Jason Lau
(74) *Attorney, Agent, or Firm* — Seager Tufte & Wickhem LLC

(57) ABSTRACT

Regulating device for gas burners for providing a gas/air mixture, with a mixing device for mixing a gas flow with a combustion air flow to provide the gas/air mixture, wherein at least one gas valve is positioned in a gas line which conducts the gas flow, which is adjusted in dependence upon a measurement signal of an electric or electronic sensor, wherein the sensor determines the differential pressure between the gas line and a reference pressure. The mixing device may be formed as a Venturi nozzle, in which the gas flow and the combustion air flow are mixed, wherein the reference pressure for the sensor is a device in which the reference pressure prevails, and the device is connected via a connecting line to the Venturi nozzle downstream of the mixing region of the Venturi nozzle.

20 Claims, 1 Drawing Sheet

(56) References Cited

U.S. PATENT DOCUMENTS

| | | | | | |
|---|---|---|---|---|---|
| 4,152,121 | A | | 5/1979 | Van Der Weide et al. | |
| 4,202,760 | A | | 5/1980 | Storey et al. | |
| 4,224,019 | A | | 9/1980 | Dilmore | |
| 4,251,025 | A | | 2/1981 | Bonne et al. | |
| 4,283,645 | A | | 8/1981 | Hofmann | |
| 4,291,658 | A | | 9/1981 | Masaki et al. | |
| 4,314,441 | A | | 2/1982 | Yannone et al. | |
| 4,329,138 | A | | 5/1982 | Riordan | |
| 4,334,855 | A | | 6/1982 | Nelson | |
| 4,340,355 | A | * | 7/1982 | Nelson et al. | 431/20 |
| 4,373,897 | A | | 2/1983 | Torborg | |
| 4,439,139 | A | | 3/1984 | Nelson et al. | |
| 4,458,719 | A | | 7/1984 | Strybel | |
| 4,502,625 | A | | 3/1985 | Mueller | |
| 4,533,315 | A | | 8/1985 | Nelson | |
| 4,576,359 | A | | 3/1986 | Oetiker | |
| 4,620,508 | A | * | 11/1986 | Fligner et al. | 122/7 R |
| 4,684,060 | A | | 8/1987 | Adams et al. | |
| 4,688,547 | A | | 8/1987 | Ballard et al. | |
| 4,703,795 | A | | 11/1987 | Beckey | |
| 4,708,636 | A | * | 11/1987 | Johnson | 431/20 |
| 4,729,207 | A | | 3/1988 | Dempsey et al. | |
| 4,767,104 | A | | 8/1988 | Plesinger | |
| 4,788,962 | A | | 12/1988 | Mashburn et al. | |
| 4,797,072 | A | | 1/1989 | Berfield et al. | |
| 4,819,587 | A | | 4/1989 | Tsutsui et al. | |
| 4,830,600 | A | | 5/1989 | VerShaw et al. | |
| 4,892,245 | A | | 1/1990 | Dunaway et al. | |
| 4,894,067 | A | | 1/1990 | Bayerstock | |
| 4,915,615 | A | | 4/1990 | Kawamura et al. | |
| 5,026,270 | A | | 6/1991 | Adams et al. | |
| 5,073,309 | A | | 12/1991 | Bousquet et al. | |
| 5,150,880 | A | | 9/1992 | Austin, Jr. et al. | |
| 5,152,276 | A | | 10/1992 | Brock et al. | |
| 5,248,083 | A | | 9/1993 | Adams et al. | |
| 5,307,990 | A | | 5/1994 | Adams et al. | |
| 5,329,955 | A | * | 7/1994 | Gensler et al. | 137/7 |
| 5,331,944 | A | | 7/1994 | Kujawa et al. | |
| 5,340,028 | A | | 8/1994 | Thompson | |
| 5,347,981 | A | | 9/1994 | Southern et al. | |
| 5,370,527 | A | | 12/1994 | Hefling et al. | |
| 5,408,986 | A | | 4/1995 | Bigham | |
| 5,431,557 | A | | 7/1995 | Hamos | |
| 5,445,516 | A | | 8/1995 | Stouffer | |
| 5,520,533 | A | | 5/1996 | Vrolijk | |
| 5,590,642 | A | | 1/1997 | Borgeson et al. | |
| 5,630,408 | A | * | 5/1997 | Versluis | 122/14.21 |
| 5,685,707 | A | * | 11/1997 | Ramsdell et al. | 431/90 |
| 5,720,231 | A | | 2/1998 | Rowlette et al. | |
| 5,732,691 | A | | 3/1998 | Maiello et al. | |
| 5,791,332 | A | | 8/1998 | Thompson et al. | |
| 5,806,440 | A | | 9/1998 | Rowlette et al. | |
| 5,819,721 | A | | 10/1998 | Carr et al. | |
| 5,827,335 | A | | 10/1998 | Ward | |
| 5,860,411 | A | | 1/1999 | Thompson et al. | |
| 5,865,611 | A | | 2/1999 | Maiello | |
| 5,971,026 | A | | 10/1999 | Beran | |
| 5,993,195 | A | | 11/1999 | Thompson | |
| 6,000,622 | A | | 12/1999 | Tonner et al. | |
| 6,030,207 | A | | 2/2000 | Saleri | |
| 6,075,922 | A | * | 6/2000 | Tay et al. | 392/416 |
| 6,109,255 | A | | 8/2000 | Dieckmann et al. | |
| 6,234,456 | B1 | | 5/2001 | Gerhardy | |
| 6,254,008 | B1 | | 7/2001 | Erickson et al. | |
| 6,257,870 | B1 | | 7/2001 | Hugghins et al. | |
| 6,283,115 | B1 | | 9/2001 | Dempsey et al. | |
| 6,287,108 | B1 | * | 9/2001 | Rothenberger et al. | 431/12 |
| 6,321,744 | B1 | | 11/2001 | Dempsey et al. | |
| 6,354,327 | B1 | | 3/2002 | Mayhew | |
| 6,377,426 | B2 | | 4/2002 | Hugghins et al. | |
| 6,401,708 | B1 | * | 6/2002 | Kim et al. | 126/116 A |
| 6,474,959 | B2 | | 11/2002 | Eisert | |
| 6,561,791 | B1 | * | 5/2003 | Vrolijk et al. | 431/12 |
| 6,571,817 | B1 | | 6/2003 | Bohan, Jr. | |
| 6,579,087 | B1 | * | 6/2003 | Vrolijk | 431/12 |
| 6,681,623 | B2 | * | 1/2004 | Bonne et al. | 73/202 |
| 6,705,533 | B2 | | 3/2004 | Casey et al. | |
| 6,749,423 | B2 | * | 6/2004 | Fredricks et al. | 431/90 |
| 6,758,909 | B2 | | 7/2004 | Jonnalagadda et al. | |
| 6,764,298 | B2 | | 7/2004 | Kim et al. | |
| 6,793,015 | B1 | | 9/2004 | Brown et al. | |
| 6,846,514 | B2 | | 1/2005 | Jonnalagadda et al. | |
| 6,866,202 | B2 | | 3/2005 | Sigafus et al. | |
| 6,880,548 | B2 | * | 4/2005 | Schultz et al. | 126/110 R |
| 6,918,756 | B2 | | 7/2005 | Fredricks et al. | |
| 6,923,643 | B2 | | 8/2005 | Schultz et al. | |
| 6,925,999 | B2 | | 8/2005 | Hugghins et al. | |
| 7,055,759 | B2 | | 6/2006 | Wacker et al. | |
| 7,101,172 | B2 | | 9/2006 | Jaeschke | |
| 7,111,503 | B2 | | 9/2006 | Brumboiu et al. | |
| 7,241,135 | B2 | | 7/2007 | Munsterhuis et al. | |
| 7,293,718 | B2 | | 11/2007 | Sigafus et al. | |
| 7,644,712 | B2 | * | 1/2010 | Schultz | 126/116 A |
| 2001/0055709 | A1 | | 12/2001 | Sang | |
| 2002/0155405 | A1 | | 10/2002 | Casey et al. | |
| 2003/0011342 | A1 | | 1/2003 | Eichorn | |
| 2005/0025638 | A1 | | 2/2005 | Buffet | |
| 2005/0155404 | A1 | | 7/2005 | Geho et al. | |
| 2006/0105279 | A1 | | 5/2006 | Munsterhuis et al. | |
| 2007/0243496 | A1 | * | 10/2007 | Thiewes et al. | 431/354 |
| 2008/0011332 | A1 | * | 1/2008 | Bailey et al. | 134/56 R |
| 2008/0124668 | A1 | * | 5/2008 | Schultz et al. | 431/89 |

FOREIGN PATENT DOCUMENTS

| | | |
|---|---|---|
| DE | 3205935 | 9/1983 |
| DE | 3604314 | 8/1987 |
| DE | 19729047 | 9/1998 |
| DE | 19733768 | 2/1999 |
| DE | 19922226 | 11/2000 |
| DE | 102004007123 | 8/2005 |
| EP | 0644377 | 3/1995 |
| EP | 0864814 | 9/1998 |
| EP | 0846916 | 10/1998 |
| EP | 0890787 | 1/1999 |
| EP | 1026445 | 8/2000 |
| EP | 1150070 | 10/2001 |
| EP | 1055085 | 1/2002 |
| EP | 1744102 | 1/2007 |
| EP | 2090827 | 8/2009 |
| FR | 2794521 | 12/2000 |
| GB | 1397536 | 6/1975 |
| GB | 2036295 | 6/1980 |
| JP | 52112830 | 9/1977 |
| JP | 52140928 | 11/1977 |
| JP | 55032923 | 3/1980 |
| JP | 56106045 | 8/1981 |
| JP | 61106957 | 5/1986 |
| JP | 1029662 | 1/1989 |
| JP | 1100357 | 4/1989 |
| JP | 1187325 | 7/1989 |
| JP | 2259269 | 10/1990 |
| JP | 5044599 | 2/1993 |
| JP | 10288483 | 10/1998 |
| NL | 1000129 | 9/1995 |
| WO | 9409326 | 4/1994 |
| WO | 02077526 | 10/2002 |

OTHER PUBLICATIONS

Honeywell, 45.801.175-, Amplification Gas/Air Module for VK4105R/VK8105R Gas Controls, pp. 1-8, prior to Oct. 18, 2006.

http://www.regal-beloit.com/gedraft.html, Welcom to GE Commercial Motors by Regal-Beloit, 1 page, printed Apr. 26, 2006.

Lennox, "G61MPV Series Units," Installation Instructions, 2 pages, Oct. 2006.

* cited by examiner

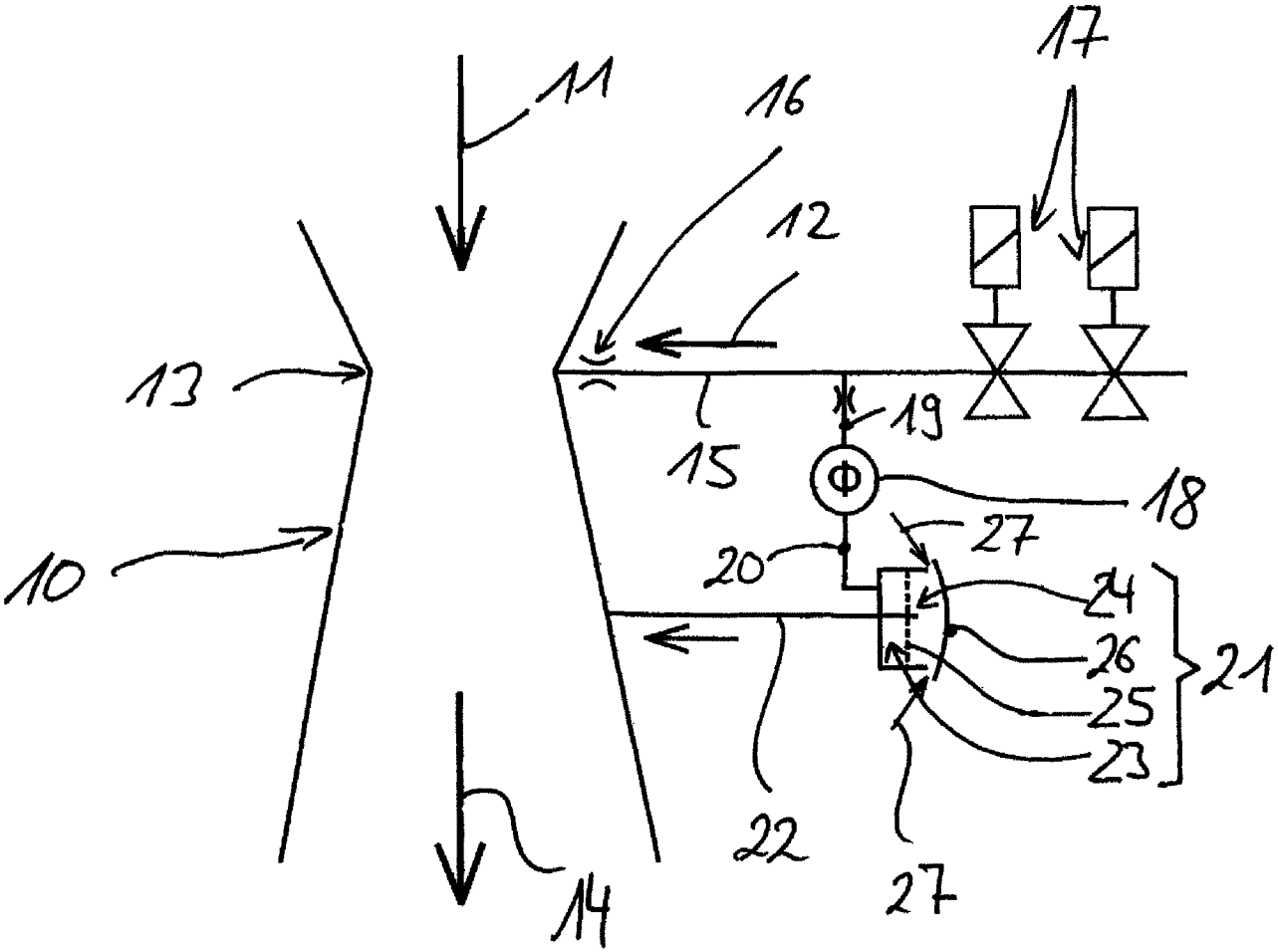
17
18
21
24
26
25
23
27
19
27
16
12
15
20
22
11
14
13
10

REGULATING DEVICE FOR GAS BURNERS

The present application claims priority to German Patent Application No. 102009048405.1, filed on Oct. 6, 2009, entitled "REGULATING DEVICE FOR GAS BURNERS", which is incorporated herein by reference.

A regulating device for gas burners for providing a gas/air mixture, that is to say for feeding a gas flow and a combustion air flow to a gas burner, is known from DE 199 22 226 C1. In the regulating device which is disclosed there, a gas flow which is conducted in a gas line is mixed with an air flow which is conducted in a combustion air line in order to thus provide the gas/air mixture which is to be fed to the gas burner, wherein this mixing of the gas flow with the combustion air flow is carried out in a mixing device which is provided as a result of the gas line leading inside the combustion air line by a gas nozzle downstream of a throttling point which is integrated in the combustion air line. The gas/air mixture which is provided in this way can be fed to the gas burner by a fan. From DE 199 22 226 C1, it is furthermore already known to regulate the gas flow through the gas line, via a gas valve which is integrated in the gas line, by means of a measurement signal which is provided by means of an electric or electronic sensor in order to thus provide a desired ratio of gas and air in the gas/air mixture. In this case, the electric or electronic sensor acts on the gas line by a measuring point in order to detect the pressure which prevails in the gas line, wherein a reference pressure prevails at a reference point of the sensor. The reference point in this case typically acts on the environment so that the reference pressure corresponds to the ambient pressure. A signal for adjusting the gas valve is generated dependent upon the measurement signal of the sensor.

A mixing device, which is formed as a Venturi nozzle, is known from DE 10 2004 007 123 B3, by means of which a gas/air mixture is provided, which is to be fed to a gas burner, a gas flow can be mixed with a combustion air flow. The Venturi nozzle which is disclosed there has an inlet opening for the combustion airflow and an outlet opening for the gas/air mixture. Via a gas conducting passage, the gas flow can be fed to the Venturi nozzle in order to mix the combustion airflow and the gaseous airflow in a mixing region of the Venturi nozzle, forming the gas/air mixture.

Under regular operating conditions, a pressure, which is lower than the reference pressure, prevails in the gas line, by means of which gas flow is fed to the mixing device. In this case, there is no risk of gas escaping from the gas line in the direction of the reference point of the sensor via the electric or electronic sensor which is typically constructed as a flow meter or as an anemometer. However, if pressure fluctuations occur in the gas line, the situation can arise of the pressure of the gas line which leads to the mixing device being greater than the reference pressure, wherein via the sensor, which acts by a measuring point on the gas line and acts by a reference point on the reference pressure, gas is then drawn from the gas line in the direction of the reference point. Since in the case of the reference pressure it is preferably the ambient pressure, gas then finds its way into the environment from the gas line via the sensor which is formed as a flowmeter or anemometer. The quantity of gas which possibly finds its way into the environment via the sensor under such conditions is low enough for it to be non-critical to safety. The quantity of gas, however, can be detected by a gas sensor so that if a fitter uses a gas sensor on such a regulating device the false impression can arise for the fitter that a quantity of gas which is critical to safety would escape into the environment via the regulating device. This can give rise to unnecessary service operations on the regulating device.

Starting from here, the invention is based on the problem of creating a new type of regulating device for gas burners. This problem is solved by means of a regulating device for gas burners with the features of Claim 1. According to the invention, the mixing device is formed as a Venturi nozzle, wherein the gas line leads to a mixing region of the Venturi nozzle in which the gas flow and the combustion air flow are mixed, forming a gas/air mixture, wherein the reference point of the sensor acts on a device in which the reference pressure prevails, and wherein the device is connected via a connecting line to the Venturi nozzle, that is to say to a region of the Venturi nozzle which, as seen in the flow direction of the gas/air mixture, lies downstream of the mixing region of the Venturi nozzle.

Via the connecting line, via which the device on which acts the reference pressure of the sensor, is connected to the Venturi nozzle, it can be ensured that as a result of pressure fluctuations in the gas line, gas, which finds its way via the sensor to the reference point of the sensor, is delivered if necessary to the Venturi nozzle. In this case, no gas at all can then find its way into the environment, which could be detected by a gas sensor. In this way, unnecessary maintenance operations on fully functional regulating devices can be avoided.

According to an advantageous development of the invention, the device, on which acts the reference point of the sensor and which is connected via the connecting line to the Venturi nozzle, has two chambers which are separated from each other by means of a filter, that is to say an inner chamber, which is separated from an ambient atmosphere via the filter, and an outer chamber, which is in communication with the ambient atmosphere, wherein the reference point of the sensor acts on the inner chamber of the device, and wherein the connecting line acts on the outer chamber of the device and connects the outer chamber of the device to the Venturi nozzle.

The subdivision of the device into two chambers, that is to say into the inner chamber and the outer chamber, has the advantage that there is no risk of impurities from the ambient atmosphere being able to find their way into the region of the electric or electronic sensor which is formed as a flowmeter or anemometer.

Preferred developments of the invention result from the dependent claims and from the subsequent description. Exemplary embodiments of the invention, without being limited thereto, are subsequently explained in more detail with reference to the drawing. In the drawing:

FIG. 1 shows a block diagram of a regulating device according to the invention for gas burners.

The present invention in this case refers to a regulating device for gas burners for providing a gas/air mixture for the gas burner.

The regulating device according to the invention is subsequently described with reference to the schematized view of FIG. 1, wherein in FIG. 1 a mixing device, formed as a Venturi nozzle 10, of a regulating device according to the invention is shown, wherein to the Venturi nozzle 10 are fed a combustion air flow 11 on the one hand and a gaseous air flow 12 on the other hand, which are mixed in a mixing region 13 of the Venturi nozzle and leave the Venturi nozzle 10 as a gas/air mixture 14.

The combustion airflow 11 can be fed to the mixing device, formed as a Venturi nozzle 10, via a combustion air line, which is not shown.

The gas flow 12 is fed to the mixing device, formed as a Venturi nozzle 10, via a gas line 15, wherein the gas line 15 leads to the mixing region 13 of the Venturi nozzle 10 via a gas nozzle 16.

Gas valves 17 are associated with the gas line 15 according to FIG. 1. The gas valves 17 can be opened and closed dependent upon a measurement signal of a sensor 18 in order to thereby adjust the quantity of gas which is fed to the Venturi nozzle 10 via the gas line 15 and so to adjust the quantity of gas in the gas/air mixture 14.

In the case of the sensor 18, it is an electric or electronic sensor 18 which is formed as a flowmeter or anemometer, which acts by a first measuring point 19 on the gas line 15 and acts by a reference point 20 on a device 21.

The gas pressure which prevails in the gas line 15 is applied to the measuring point 19. The reference pressure which prevails in the device 21 is applied to the reference point 20, wherein in the case of the reference pressure it is preferably the ambient pressure of the environment of the regulating device.

The device 21, on which acts the reference point 20 of the sensor 18, is connected via a connecting line 22 to the mixing device, formed as a Venturi nozzle 10, of the regulating device according to the invention, wherein the connecting line 22 acts on the Venturi nozzle 10 on a region or section of the Venturi nozzle which, as seen in the flow direction of the gas/air mixture 14, lies downstream of the mixing region 13 of the Venturi nozzle 10.

If, induced by pressure fluctuations in the gas line 15, gas should find its way into the region of the device 21 via the sensor 18, this gas can be delivered or diverted from the device 21, via the connecting line 22, into the Venturi nozzle 10, so that there is then no risk at all of even the smallest quantities of gas finding their way into the environment of the regulating device.

The device 21, on which acts the reference point 20 of the sensor 18 and which is connected via the connecting line 22 to the Venturi nozzle 10, preferably comprises two chambers 23 and 24 which are separated from each other by means of a filter 25.

An inner chamber 23 is separated from the outer chamber 24 via the filter 25 and therefore separated from the ambient atmosphere. The outer chamber 24 is in communication with the ambient atmosphere.

The reference point 20 of the sensor 19 acts on the inner chamber 23 which is separated from the ambient atmosphere via the filter 25. The connecting line 22 acts on the outer chamber 22 which is in communication with the ambient atmosphere, wherein the connecting line 22 connects the outer chamber 24 of the device 21 to the Venturi nozzle 10.

If, on account of pressure fluctuations in the gas line 15 which leads to the mixing region 13 of the Venturi nozzle 10, an overpressure prevails, gas, via the sensor 18, finds its way into the inner chamber 23 of the device 21 and via the filter 25 finds its way into the outer chamber 24 of the device 21, wherein on the basis of the negative pressure in the Venturi nozzle 10 this gas is drawn from the outer chamber 24 of the device 21 via the connecting line 22 and fed to the Venturi nozzle 10.

If, in the gas line 15 which leads to the mixing region 13 of the Venturi nozzle 10 a negative pressure prevails, ambient air can find its way from the outer chamber 24 of the device 21, only after passing through the filter 25, into the inner chamber 23 and therefore into the region of the sensor 18, wherein by the filter 25 being constructed as a fine dust filter it is ensured that no fine dust at all finds its way from the environment into the region of the sensor 18 and damages the sensor or impairs it in some other way.

According to FIG. 1 a flow guiding element 26 is associated with the device 21, that is to say with the outer chamber 24 of the device. The flow guiding element 26 serves for guiding an airflow 27 which finds its way from the environment into the outer chamber 24 of the device 21. Furthermore, the flow guiding element 26 serves for guiding a flow which crosses over from the inner chamber 23 of the device 21 into the outer chamber 24 of the device after passing through the filter 25.

Via the flow guiding element 26, these flows can be guided and captured so that it is then reliably ensured that gas which finds its way into the outer chamber 24 can be captured and safely and reliably fed to the Venturi nozzle 10 via the connecting line 22.

With the regulating device according to the invention, there is no risk, even in the case of pressure fluctuations in the gas line 25, of even the smallest quantities of gas finding their way into the environment of the regulating device, which admittedly does not impair the functioning capability and reliability of the regulating device but which can be detected by a gas sensor. As a result of this, unnecessary maintenance operations on the regulating device can be avoided.

LIST OF DESIGNATIONS

10. Venturi nozzle
11. Combustion air flow
12. Gas flow
13. Mixing region
14. Gas/air mixture
15. Gas line
16. Gas nozzle
17. Gas valve
18. Sensor
19. Measuring point
20. Reference point
21. Device
22. Connecting line
23. Inner chamber
24. Outer chamber
25. Filter
26. Flow guiding element
27. Ambient air flow

What is claimed is:

1. A regulating device for providing a desired gas/air mixture to a gas burner, wherein a gas line provides a source of gas to a gas valve, and the gas valve provides a regulated gas flow based at least in part on a signal provided by a sensor, wherein the signal provided by the sensor is related to a gas pressure of the regulated gas flow against a reference pressure at a reference pressure input of the sensor, the regulating device comprising:

a mixing device for mixing the regulated gas flow with a combustion air flow to produce a gas/air mixture to the gas burner, the mixing device includes a venturi nozzle, wherein the regulated gas flow is provided to a mixing region of the venturi nozzle in which the regulated gas flow and the combustion air flow are mixed to form the desired gas/air mixture;

a device having an inner chamber and an outer chamber separated by a filter, wherein the inner chamber is fluidly coupled to the reference pressure input of the sensor, and the outer chamber is fluidly coupled to a region of the mixing device that is downstream of the mixing region of the venturi nozzle via a connecting line; and a flow guiding element associated with the outer chamber of the device, wherein the flow guiding element helps guide and/or capture an ambient air flow from an ambient atmosphere to the outer chamber, and further helps guide and/or capture a flow from the reference pressure input of the sensor, which has crossed over from the inner chamber and into the outer chamber through the filter.

2. The regulating device of claim 1, wherein the region of the mixing device that is downstream of the mixing region is also in the venture nozzle.

3. The regulating device of claim 1, wherein the sensor is flowmeter.

4. The regulating device of claim 1, wherein the sensor is anemometer.

5. A regulating device for providing a desired gas/air mixture to a gas burner, wherein a gas line provides a source of gas to a gas valve, and the gas valve provides a regulated gas flow based at least in part on a signal provided by a sensor, wherein the signal provided by the sensor is related to a gas pressure of the regulated gas flow against a reference pressure at a reference pressure input of the sensor, the regulating device comprising:

a mixing device for mixing the regulated gas flow with a combustion air flow to produce a gas/air mixture to the gas burner;

the mixing device includes a venturi nozzle, wherein the regulated gas flow is provide to a mixing region of the venturi nozzle in which the regulated gas flow and the combustion air flow are mixed to form the desired gas/air mixture; and a device fluidly coupled to the reference pressure input of the sensor, wherein the device is connected via a connecting line to a region of the mixing device that is downstream of the mixing region of the venturi nozzle.

6. The regulating device of claim 5, wherein the device has an inner chamber and an outer chamber, with the inner chamber in fluid communication with but separated from the outer chamber by a filter; and wherein the inner chamber is in fluid communication with the reference pressure input of the sensor.

7. The regulating device of claim 6, wherein the outer chamber is in fluid communication with an ambient atmosphere and is further in fluid communication with the connecting line that connects the device to the region of the mixing device that is downstream of the mixing region of the venturi nozzle.

8. The regulating device of claim 7, further comprising a flow guiding element associated with the outer chamber of the device, wherein the flow guiding element helps guide and/or capture an ambient air flow from the ambient atmosphere to the outer chamber, and further helps guide and/or capture a flow from the reference pressure input of the sensor, which has crossed over from the inner chamber and into the outer chamber through the filter.

9. The regulating device of claim 6, wherein the filter is a dust filter which limits crossing over of dust from the outer chamber into the inner chamber and into the reference pressure input of the sensor.

10. The regulating device of claim 5, wherein the sensor is flowmeter, and the signal provided by the sensor represents a flow rate between the regulated gas flow and the reference pressure input of the sensor.

11. A regulating device for providing a desired gas/air mixture to a gas burner, wherein a gas line provides a source of gas to a gas valve, and the gas valve provides a regulated gas flow based at least in part on a signal provided by a sensor, wherein the signal provided by the sensor is related to a differential gas pressure between the regulated gas flow and a reference pressure at a reference pressure input of the sensor, the regulating device comprising:

a mixing device for mixing the regulated gas flow with a combustion air flow to produce a gas/air mixture to the, gas burner, wherein the regulated gas flow is provide to a mixing region of the mixing device in which the regulated gas flow and the combustion air flow are mixed to form the desired gas/air mixture; and a device having a chamber, wherein the chamber of the device is in fluid communication with:

the reference pressure input of the sensor;

an ambient atmosphere; and a region of the mixing device that is downstream of the mixing region.

12. The regulating device of claim 11, wherein the region of the mixing device that is downstream of the mixing region is fluidly connected to the chamber of the device via a connecting line.

13. The regulating device of claim 12, wherein the chamber of the device includes an inner chamber and an outer chamber, wherein the inner chamber is separated from the outer chamber by a filter.

14. The regulating device of claim 13, wherein the reference pressure input of the sensor is in fluid communication with the inner chamber, and is in fluid communication with the outer chamber through the inner chamber and the filter.

15. The regulating device of claim 14, wherein the outer chamber is in fluid communication with the ambient atmosphere.

16. The regulating device of claim 15, wherein the outer chamber is in fluid communication with the region of the mixing device that is downstream via the connecting line.

17. The regulating device of claim 16, wherein the inner chamber is in fluid communication with the region of the mixing device that is downstream via the filter and then the connecting line.

18. The regulating device of claim 17, further comprising a flow guiding element associated with the outer chamber of the device, wherein the flow guiding element helps guide and/or capture an ambient air flow from the ambient atmosphere to the outer chamber, and further helps guide and/or capture a flow from the reference pressure input of the sensor, which has crossed over from the inner chamber and into the outer chamber through the filter.

19. The regulating device of claim 11, wherein mixing device includes a venturi nozzle, wherein the mixing region is in the venturi nozzle.

20. The regulating device of claim 19, wherein the region of the mixing device that is downstream of the mixing region is also in the venture nozzle.

* * * * *